US006443804B1

(12) United States Patent
Grunwald

(10) Patent No.: US 6,443,804 B1
(45) Date of Patent: Sep. 3, 2002

(54) GARMENT WITH QUICK-RELEASE FASTENER

(76) Inventor: David J. Grunwald, 60 Old Town Rd., 13, Vernon, CT (US) 06066

( * ) Notice: Subject to any disclaimer, the term of this patent is extended or adjusted under 35 U.S.C. 154(b) by 90 days.

(21) Appl. No.: 09/657,138

(22) Filed: Sep. 7, 2000

(51) Int. Cl.[7] ..... A41C 3/00

(52) U.S. Cl. ..... 450/28; 450/26; 24/588.1; 24/588.12

(58) Field of Search ..... 450/1, 28, 86, 450/26, 63, 73, 9, 13, 17, 25, 79, 80, 134, 135, 136, 139, 142; 24/588.1, 588.12, 592.1, 698.3, 601.8, 601.3; 2/311, 312, 338, 105, 106, 93, 94, 85, 102, 95, 96, 100, 108, 128, 132, 138, 141.1, 145, 218, 219, 321, 251, 252, 263, 262, 257, 259, 270, 271

(56) References Cited

U.S. PATENT DOCUMENTS 655,856 A * 8/1900 DooLittle ..... 24/588.1
739,727 A * 9/1903 Scott ..... 24/588.1
761,008 A * 5/1904 Peet ..... 24/588.1
825,701 A * 7/1906 Browning ..... 24/588.1
840,266 A * 1/1907 Sowar ..... 24/588.1
853,320 A * 5/1907 Reid ..... 24/588.1
853,377 A * 5/1907 Reid ..... 24/698.3
981,375 A * 1/1911 Browning ..... 24/601.3
1,152,894 A * 9/1915 Jacobson ..... 24/601.3
1,248,298 A * 11/1917 Farrar ..... 24/698.3
1,311,499 A * 7/1919 Darr ..... 24/588.1
2,061,125 A * 11/1936 Wener ..... 24/588.1
3,382,548 A * 5/1968 Rose ..... 24/588.1

* cited by examiner

*Primary Examiner*—Gloria M. Hale
(74) *Attorney, Agent, or Firm*—Ira S. Dorman

(57) ABSTRACT

A fastener for securing brassiere straps includes a hooking component attached to one of the straps and a linking component attached to the other strap. The hooking component has a substantially rigid body, with a fulcrum element at one end, a handle element at the other end, and a hook element therebetween. Elevating the body promotes disengagement of the hook and link elements, and thereby mutual release of the brassiere straps.

16 Claims, 2 Drawing Sheets

GARMENT WITH QUICK-RELEASE FASTENER

BACKGROUND OF THE INVENTION

Hook-and-eye fasteners are widely utilized on undergarments and outerwear. Disengagement of the fastener components to disconnect attached portions of a garment can often be difficult and inconvenient, and this is particularly so when the secured portions are normally at the wearer's back and/or when they are under tension due to incorporated elastic elements or elasticized-fabric construction. Typically, such difficulties arise in opening the fastened straps of a brassiere.

SUMMARY OF THE INVENTION

Accordingly, it is a broad object of the present invention to provide a garment having first and second portions that are constructed for being secured to one another in an adjacent relationship, wherein the fastener utilized affords secure interengagement while, at the same time, enabling facile disengagement when the garment portions are to be separated from one another.

More specific objects of the invention are to provide such a garment, and in particular a brassiere, which utilizes a hook-and-eye type of fastener.

Additional specific objects of the invention are to provide a garment having the foregoing features and advantages, in which the garment fastener includes at least two pairs of elements that are simultaneously disengaged upon operation of the release feature.

It has now been found that certain of the foregoing and related objects of the invention are attained by the provision of a garment comprised of first and second portions constructed for being secured to one another in an adjacent relationship, and a fastener that includes a hooking component and a linking component operatively attached, respectively, to the portions of the garment. The hooking component comprises a substantially rigid body having proximal and distal end portions, and a hook element spaced from the proximal end, the proximal end portion providing a fulcrum element about which the body can pivot and the distal end portion providing a handle element by which such pivoting can be effected. The hook element defines a recess that opens in the direction of the fulcrum element, and the linking component includes a link element that is dimensioned and configured for insertion into the recess of the hook element for engagement thereby; the effective position of the hook element will normally be such as to dispose the fully seated link element between the proximal and distal ends of the fastener body. Pivoting of the body about the fulcrum element, and away from the linking component, promotes disengagement of the hook and link elements and thereby the release of the secured garment portions from one another.

The garment will usually include elastic means for applying tension when the first and second portions thereof (e.g., the straps of a brassiere) are secured by the fastener. The hooking component will normally be covered by a fabric, through which at least the hook element of the hooking component will be accessible to the cooperating link element.

In certain embodiments the fastener (or a number of such fasteners) will provide a plurality of hook elements on the "first" garment portion, and a corresponding plurality of link elements on the "second" garment portion, the elements being so arranged as to permit the hook elements to concurrently engage with, and substantially simultaneously disengage from, corresponding link elements by pivoting of the fastener body. In those instances in which a plurality of hooking components are employed, the fulcrum elements of the hooking component bodies will be substantially aligned on a common axis, from which axis the hook elements will be substantially equidistantly spaced, so as to permit disengagement of all of the elements upon simultaneous pivoting of the bodies. A covering fabric of the garment may integrate separate hooking components for conjoined pivotal movement; the link elements may also be provided individually or by a single linking component.

The hooking component body will typically be of tab-like form (i.e., small, thin and substantially flat), and its proximal end portion will advantageously have a substantially rectilinear edge portion to conveniently provide an inherent fulcrum element. The body may be formed from a length of wire having contiguous segments affixed to one another. In those embodiments in which the garment is a brassiere or the like, the hooking component will desirably have a slightly arcuate contour, with the hook element projecting from its concave side, to comfortably conform to the wearer's body.

DETAILED DESCRIPTION OF THE PREFERRED AND ILLUSTRATED EMBODIMENT

Figure 1:
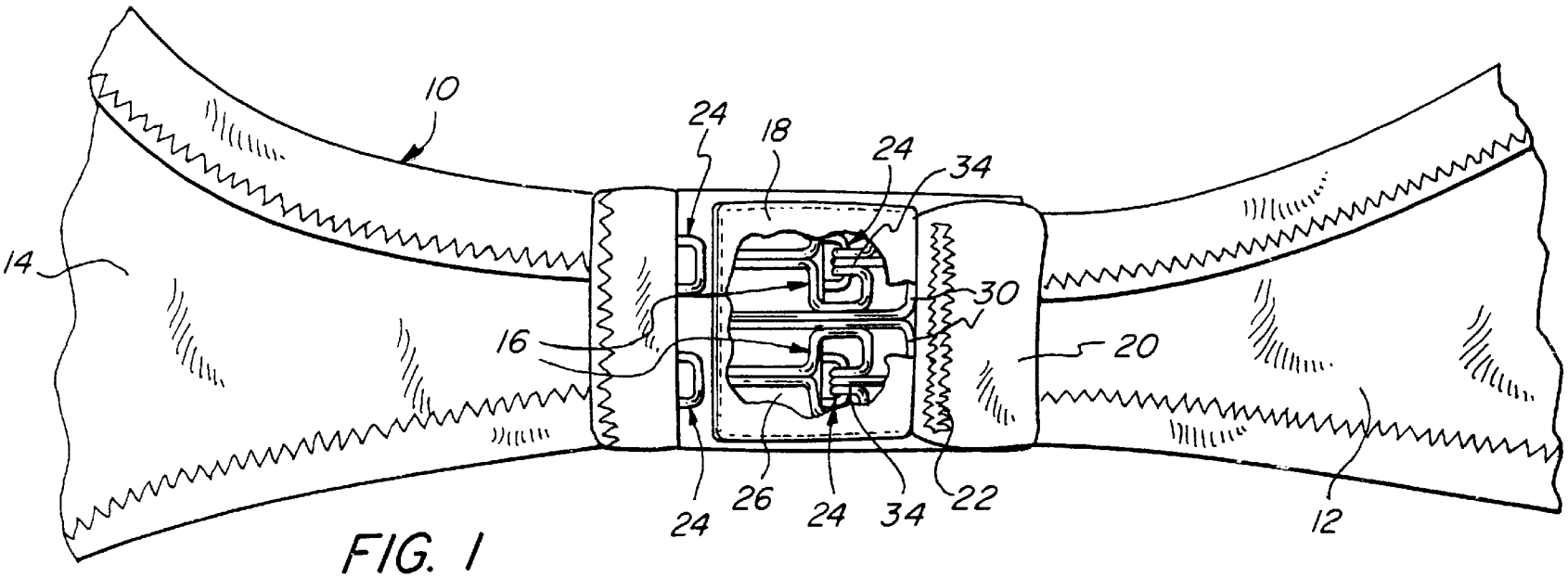
FIG. 1 is a fragmentary plan view of a brassiere embodying the present invention, the strap portions shown being secured to one another by the novel fasteners hereof, and fabric sections being broken away to expose underlying features.

Turning now in detail to the appended drawings, therein illustrated is a brassiere, generally designated by the numeral 10, which includes two strap portions 12, 14 secured to one another, in an adjacent relationship, by fasteners embodying the invention; the strap portions are fabricated, at least in part, from an elasticized fabric. Each fastener comprises a hooking component generally designated by the numeral 16, the components 16 being operatively attached, in a side-by-side, ganged relationship, to the strap portion 12; they are enclosed in a fabric covering sleeve 18, which is in turn affixed by a line of stitching 22 within a cuff 20 attached to the end of the strap portion 12. Six linking components 24 (i.e., loops, or eyes), only four of which are visible, are attached to the strap portion 14 by securing them as side-by-side pairs within the folded fabric sections 26, thus providing three positions in which the strap portions can be secured, as is conventional. The broken-away area of the covering sleeve 18 exposes, in FIG. 1, the interengaged relationship of the two hooking components 16 with a pair of link elements 24.

Figure 3:
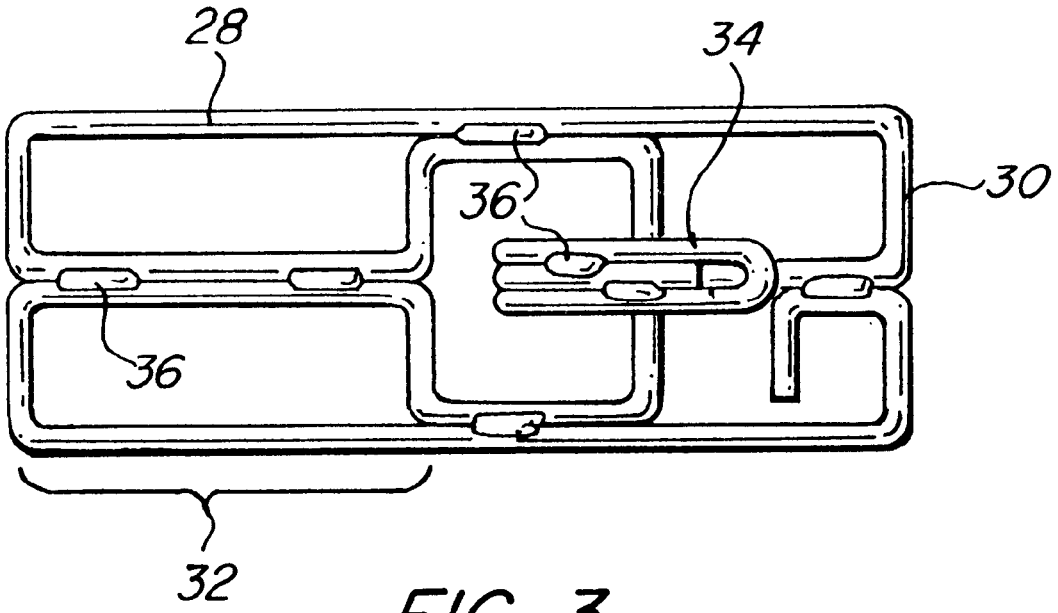
FIG. 3 is a plan view of the hooking component comprising a fastener employed in the brassiere of FIGS. 1 and 2.

As is best seen in FIG. 3, each hooking component 16 is constructed from a length of metal wire 28, formed into a generally rectangular, tab-like body providing a generally rectilinear, two-part fulcrum element 30 at one end and a handle element 32 at the opposite end. A hook element 34 is also formed from the wire 28, and is disposed at a location between the fulcrum element 30 and the handle element 32.

Figure 2:
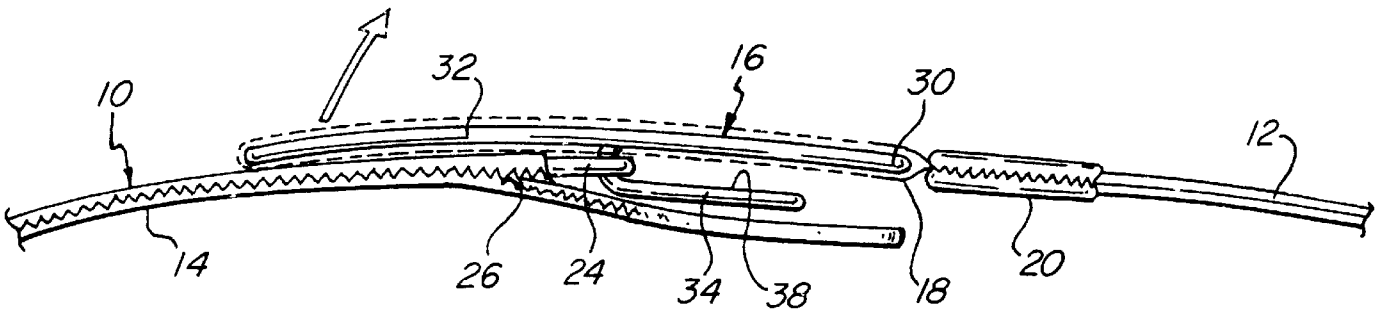
FIG. 2 is a fragmentary side elevational view of the brassiere of FIG. 1, drawn to an enlarged scale and having most of the fabric covering the fastener shown in dotted line.
Figure 4:
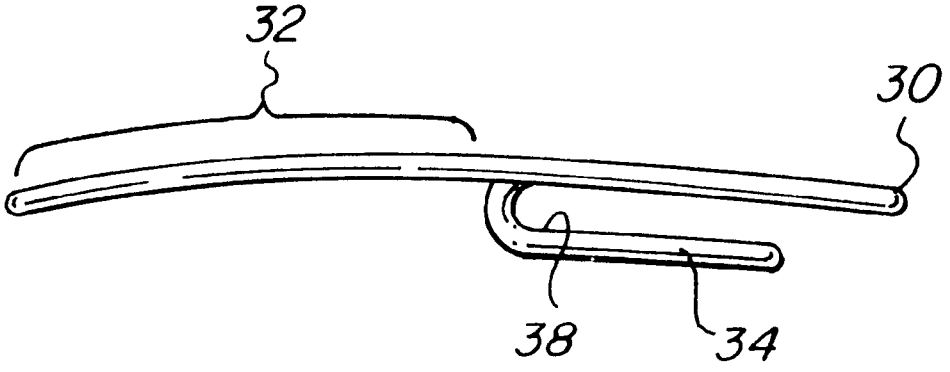
FIG. 4 is a side elevational view of the hooking component of the preceding Figures.

As is best seen in FIG. 2 and 4, the hook element 34 defines a recess 38 which opens in the direction of the fulcrum element 30, and it projects from the concave side of the body which, albeit substantially flat, is formed with a slight arcuate contour to better conform to the wearer's back. A number of contiguous segments along the length of the formed wire are affixed to one another by deposits 36 of solder (albeit welding, adhesive bonding, or other means could of course be used), to integrate and strengthen the hooking component body and to ensure that it is substantially rigid (i.e., sufficiently rigid to resist undue flexure under manual lifting force).

As is seen in FIGS. 1 and 2 (and as would be self-evident in any event), the strap portions 12, 14 are secured by inserting the hook elements 34 of the ganged hooking components 16 through the link elements of the linking components 24 of either of the two side-by-side pairs thereof. As indicated by the arrow in FIG. 2, release is affected by pivoting the hooking components about their aligned fulcrum elements 30 away from the linking components. This of course promotes outward sliding movement of the link elements of the components 24, freeing them from the hook elements and thereby effecting disengagement of the brassiere strap portions.

Although the description is directed primarily to a brassiere, it will be appreciated that other kinds of garments, including both outer garments and underwear, may embody the present invention. The fastener itself may of course take many different shapes and forms. Rather than being of wire construction, for example, the hooking component may be of stamped metal or molded plastic construction; indeed, it may be a composite having discrete portions made from different natural and synthetic materials. Although the hooking component will usually be provided as a single piece, moreover, it may alternatively comprise an articulated assembly in which the fulcrum element is displaced from the proximal end of the component (i.e., at the point of articulation). The hook element may be disposed at the extreme distal end of the hooking component body, rather than lying between it and the proximal end, thus allowing the body to serve as a handle albeit with reduction of the leverage advantage afforded, and the hook element may, if so desired, be formed with a small internal bump to minimize the likelihood of inadvertent disengagement. Several hook elements may be provided on the same component, or (as illustrated) several separate components may be used. Similarly, several link elements may be provided independently or as sections of a single linking component, which component may also take a variety of forms and be made from any suitable material.

Thus, it can be seen that the present invention provides a garment, and in particular a brassiere, having first and second portions that are constructed for being secured to one another in an adjacent relationship, wherein the fastener employed affords secure interengagement while, at the same time, enabling facile disengagement when the secured portions are to be released from one another. The fastener may advantageously include at least two hook and link elements that are simultaneously disengaged upon operation of the release feature.

Having thus described the invention, what is claimed is:

1. A garment comprised of first and second portions constructed for being secured to one another in an adjacent relationship, and at least one fastener for effecting such securement; said at least one fastener including a hooking component and a linking component operatively attached, respectively, to said first and second portions of said garment, said hooking component being comprised of a substantially rigid body having proximal and distal end portions and a hook element spaced from the distal end toward the proximal end, said proximal end portion of said body providing a fulcrum element about which said body can pivot, relative to said first garment portion, and said distal end portion providing a handle element by which such pivoting of said body can be effected, said hook element defining a recess that opens in the direction of said fulcrum element to receive a link element for engagement by said hook element to secure said first and second garment portions to one another, said linking component including a link element dimensioned and configured for insertion into said recess of said hook element for engagement thereby; whereby, with said garment portions so secured, pivoting of said body of said at least one fastener, about said fulcrum element and away from said linking component, will promote disengagement of said hook and link elements and, thereby, release of said garment portions from one another.

2. The garment of claim 1 wherein said hook element is effectively disposed between said distal and proximal ends.

3. The garment of claim 1 wherein said garment is a brassiere.

4. The garment of claim 1 wherein said garment includes elastic means for applying tension to said first and second portions thereof when said first and second portions are so secured by said fastener.

5. The garment of claim 1 wherein at least said first portion of said garment is comprised of fabric, and wherein said hooking component is covered substantially completely by fabric of said first portion, at least said hook element of said hooking component being accessible to said link element through said fabric.

6. The garment of claim 1 wherein said at least one fastener provides a plurality of said hook elements on said first garment portion, and a corresponding plurality of said link elements on said second garment portion, said hook elements and said link elements being so arranged as to permit each of said hook elements, concurrently with the other of said hook elements, to engage a corresponding link element, and to permit substantially simultaneous disengagement of all of said hook and link elements by such pivoting of said body of said at least one fastener.

7. The garment of claim 6 including a plurality of said hooking components providing said plurality of hook elements, said fulcrum elements of said hooking component bodies being substantially aligned on a common axis, from which axis said hook elements are substantially equidistantly spaced, so as to permit substantially simultaneous disengagement of said elements upon simultaneous pivoting of said bodies.

8. The garment of claim 7 wherein at least said first portion of said garment is of fabric construction, and wherein said hooking components are covered substantially by fabric of said first portion, at least said hook elements of said hooking components being accessible to said link elements through said fabric.

9. The garment of claim 8 wherein fabric of said first portion unites said hooking components for conjoined pivotal movement.

10. The garment of claim 7 including a plurality of said linking components.

11. The garment of claim 1 wherein said proximal end portion of said hooking component body has a substantially rectilinear edge portion at said proximal end, by which said fulcrum element is provided.

12. The garment of claim 1 wherein said hooking component body is of thin, substantially flat form.

13. The garment of claim 12 wherein said hooking component body is formed from at least one length of wire, at least a plurality of segments along said at least one length of wire being contiguous in said body, and affixed to one another.

14. The garment of claim 13 wherein said linking component comprises a formed wire loop.

15. The garment of claim 3 wherein said hooking component is of thin, slightly arcuate form, with a convex side and a concave side, said hook element projecting from said concave side of said body.

16. A brassiere comprised of first and second portions constructed for being secured to one another in an adjacent relationship, and including elastic means for applying tension to said first and second portions when so secured; and at least one fastener for effecting such securement of said first and second portions, said at least one fastener including a hooking component and a linking component operatively attached, respectively, to said first and second portions of said brassiere, said hooking component being comprised of a substantially rigid body having proximal and distal end portions and a hook element effectively disposed therebetween, said proximal end portion of said body providing a fulcrum element about which said body can pivot, and said distal end portion providing a handle element by which such pivoting of said body can be effected, said hook element defining a recess that opens in the direction of said fulcrum element to receive a link element for engagement by said hook element to secure said first and second brassiere portions to one another, said linking component including a link element dimensioned and configured for insertion into said recess of said hook element for engagement thereby; whereby, with said brassiere portions so secured, pivoting of said body of said at least one fastener, about said fulcrum element and away from said linking component, will promote disengagement of said hook and link elements and, thereby, release of said brassiere portions from one another.

* * * * *